US008916112B2

(12) United States Patent
Garcia Da Fonseca et al.

(10) Patent No.: US 8,916,112 B2
(45) Date of Patent: Dec. 23, 2014

(54) LIQUID DISTRIBUTION AND METERING

(75) Inventors: João Garcia Da Fonseca, Azambuja (PT); Nuno Alexandre Esteves Reis, Amadora (PT)

(73) Assignee: Biosurfit, S.A., Aveiro (PT)

( * ) Notice: Subject to any disclaimer, the term of this patent is extended or adjusted under 35 U.S.C. 154(b) by 36 days.

(21) Appl. No.: 13/638,378

(22) PCT Filed: Mar. 26, 2011

(86) PCT No.: PCT/PT2011/000009

§ 371 (c)(1),
(2), (4) Date: Dec. 11, 2012

(87) PCT Pub. No.: WO2011/122972

PCT Pub. Date: Oct. 6, 2011

(65) Prior Publication Data

US 2013/0074962 A1 Mar. 28, 2013

(30) Foreign Application Priority Data

Mar. 29, 2010 (GB) ..... 1005294.2

(51) Int. Cl.
*F17D 1/08* (2006.01)
*B01L 3/00* (2006.01)

(52) U.S. Cl.
CPC ..... *F17D 1/08* (2013.01); *B01L 3/50273* (2013.01); *B01L 2200/0642* (2013.01); *B01L 2200/0621* (2013.01); *B01L 2200/0605* (2013.01); *B01L 2300/048* (2013.01); *B01L 2300/0806* (2013.01); *B01L 2300/0864* (2013.01); *B01L 2300/087* (2013.01); *B01L 2400/0406* (2013.01); *B01L 2400/0409* (2013.01)
USPC ..... 422/506; 422/72; 422/503; 435/286.1; 436/180; 210/767

(58) Field of Classification Search
None
See application file for complete search history.

(56) References Cited

U.S. PATENT DOCUMENTS 5,087,532 A 2/1992 Challener, IV
5,414,678 A 5/1995 Challener, IV (Continued)

FOREIGN PATENT DOCUMENTS

DE 102005048233 4/2007
EP 0608006 7/1994

(Continued)

OTHER PUBLICATIONS

Notification of Reasons for Refusal for Japanese Application No. 2011-543549, dispatch date May 7, 2013.

(Continued)

*Primary Examiner* — Jill Warden
*Assistant Examiner* — Timothy G Kingan
(74) *Attorney, Agent, or Firm* — Patterson Thuente Pedersen, P.A.

(57) ABSTRACT

Devices for handling liquid, for example microfluidic devices, are described, which are rotatable about an axis of rotation to drive liquid flow within the device. The 5 devices provide one or more of an aliquoting structure (6) having a plurality of daisy chained aliquoting chambers (100, 200, 300) for providing a plurality of aliquots, arrangements for sequencing the dispensing of the aliquots by controlling the rotation of the device and arrangements for ensuring that a fault condition can be detected when insufficient liquid is present in the device to fill 10 all aliquots. Further disclosed are arrangements for ensuring a detection chamber (12) of the device remains filled with liquid, arrangements for reducing the risk of air ingress to the detection chamber (12) on repeated emptying and filling of a supply structure (10) and arrangements for reducing the risk of bubble formation when filling the detection chamber (12). A corresponding system for operating the 15 device and method for processing of a sample using the device is also disclosed.

15 Claims, 7 Drawing Sheets

(56) References Cited

U.S. PATENT DOCUMENTS

| | | | | |
|---|---|---|---|---|
| 5,508,982 | A | 4/1996 | Challener, IV | |
| 5,620,792 | A | 4/1997 | Challener, IV | |
| 5,639,567 | A | 6/1997 | Challener, IV | |
| 5,751,482 | A | 5/1998 | Challener, IV | |
| 5,925,878 | A | 7/1999 | Challener | |
| 5,955,378 | A | 9/1999 | Challener | |
| 5,986,762 | A | 11/1999 | Challener | |
| 5,986,997 | A | 11/1999 | Challener, IV | |
| 5,994,150 | A | 11/1999 | Challener et al. | |
| 6,063,589 | A | 5/2000 | Kellogg et al. | |
| 6,100,991 | A | 8/2000 | Challener | |
| 6,230,991 | B1 | 5/2001 | Steinruck et al. | |
| 6,235,531 | B1 | 5/2001 | Kopf-Sill et al. | |
| 6,277,653 | B1 | 8/2001 | Challener et al. | |
| 6,320,991 | B1 | 11/2001 | Challener et al. | |
| RE37,473 | E | 12/2001 | Challener | |
| 6,344,490 | B1 | 2/2002 | Degeorge et al. | |
| 6,625,336 | B2 | 9/2003 | Challener et al. | |
| 6,632,399 | B1 | 10/2003 | Kellogg et al. | |
| 6,653,152 | B2 | 11/2003 | Challener | |
| 6,944,101 | B2 | 9/2005 | Johns et al. | |
| 6,944,112 | B2 | 9/2005 | Challener | |
| 7,027,700 | B2 | 4/2006 | Challener | |
| 7,106,935 | B2 | 9/2006 | Challener | |
| 7,266,268 | B2 | 9/2007 | Challener et al. | |
| 7,272,102 | B2 | 9/2007 | Challener | |
| 7,275,858 | B2 | 10/2007 | Andersson et al. | |
| 7,330,404 | B2 | 2/2008 | Peng et al. | |
| 7,412,143 | B2 | 8/2008 | Rottmayer et al. | |
| 7,440,660 | B1 | 10/2008 | Jin et al. | |
| 7,480,214 | B2 | 1/2009 | Challener et al. | |
| 7,515,372 | B2 | 4/2009 | Erden et al. | |
| 7,580,602 | B2 | 8/2009 | Itagi et al. | |
| 7,768,657 | B2 | 8/2010 | Jin et al. | |
| 7,796,487 | B2 | 9/2010 | Chu et al. | |
| 7,804,656 | B2 | 9/2010 | Gomez et al. | |
| 7,830,775 | B2 | 11/2010 | Karns et al. | |
| 7,869,162 | B2 | 1/2011 | Lu et al. | |
| 7,869,309 | B2 | 1/2011 | Mihalcea et al. | |
| 7,893,497 | B2 | 2/2011 | Takasu | |
| 8,440,147 | B2 | 5/2013 | Da Fonseca et al. | |
| 2001/0031503 | A1 | 10/2001 | Challener et al. | |
| 2002/0122364 | A1 | 9/2002 | Worthington et al. | |
| 2003/0128633 | A1 | 7/2003 | Batra et al. | |
| 2003/0137772 | A1 | 7/2003 | Challener | |
| 2004/0053290 | A1 | 3/2004 | Terbrueggen et al. | |
| 2004/0240327 | A1 | 12/2004 | Sendur et al. | |
| 2005/0157597 | A1 | 7/2005 | Sendur et al. | |
| 2005/0217741 | A1 | 10/2005 | Bohm | |
| 2006/0144802 | A1* | 7/2006 | Kitawaki et al. | 210/782 |
| 2006/0233061 | A1 | 10/2006 | Rausch et al. | |
| 2007/0115787 | A1 | 5/2007 | Itagi et al. | |
| 2007/0125942 | A1* | 6/2007 | Kido | 250/284 |
| 2007/0262034 | A1* | 11/2007 | Ducree et al. | 210/788 |
| 2008/0019875 | A1* | 1/2008 | Shiga | 422/72 |
| 2008/0149190 | A1* | 6/2008 | Bedingham et al. | 137/340 |
| 2008/0170319 | A1 | 7/2008 | Seigler et al. | |
| 2009/0120504 | A1 | 5/2009 | Andersson et al. | |
| 2009/0207519 | A1 | 8/2009 | Erden et al. | |
| 2009/0208171 | A1 | 8/2009 | Gage et al. | |
| 2009/0246082 | A1* | 10/2009 | Saiki et al. | 422/72 |
| 2010/0097901 | A1 | 4/2010 | Challener et al. | |
| 2010/0123965 | A1 | 5/2010 | Lee et al. | |
| 2011/0044147 | A1 | 2/2011 | Karns et al. | |
| 2011/0290718 | A1 | 12/2011 | Da Fonseca et al. | |
| 2012/0021447 | A1 | 1/2012 | Da Fonseca et al. | |
| 2013/0027688 | A1 | 1/2013 | Da Fonseca et al. | |
| 2014/0109972 | A1 | 4/2014 | Da Fonseca et al. | |

FOREIGN PATENT DOCUMENTS

| | | |
|---|---|---|
| EP | 1900433 | 3/2008 |
| EP | 2080554 | 7/2009 |
| JP | 02-280084 | 11/1990 |
| JP | 2004117048 | 4/2004 |
| WO | WO95/33986 | 12/1995 |
| WO | WO9708556 | 3/1997 |
| WO | WO97/21090 | 6/1997 |
| WO | WO0146465 | 6/2001 |
| WO | WO03/058641 | 7/2003 |
| WO | WO03060882 | 7/2003 |
| WO | WO03064998 | 8/2003 |
| WO | WO03102559 | 12/2003 |
| WO | WO2004003891 | 1/2004 |
| WO | WO2004003932 | 1/2004 |
| WO | WO2004032118 | 4/2004 |
| WO | WO2004107323 | 12/2004 |
| WO | WO2005045815 | 5/2005 |
| WO | WO2007024829 | 3/2007 |
| WO | WO2007091097 | 8/2007 |
| WO | WO2008057000 | 5/2008 |
| WO | WO2008060172 | 5/2008 |
| WO | WO2008/080049 | 7/2008 |
| WO | WO2008106782 | 9/2008 |
| WO | WO2010047609 | 4/2010 |
| WO | WO2010059736 | 5/2010 |
| WO | WO2010077159 | 7/2010 |

OTHER PUBLICATIONS

International Search Report for International Application No. PCT/PT2011/000009 dated Oct. 18, 2011.

International Search Report for International Application No. PCT/PT2009/000055 dated Apr. 7, 2010 and Great Britain Search Report for GB Application No. 0819508.3 dated Feb. 26, 2009.

Schomburg et al, "Microfluidic components in LIGA technique" J. Micromech. Microeng. vol. 4, pp. 186-191 (1994).

Ducree et al., "The Centrifugal microfluidic Bio-Disk platform," J. Micromech. Microeng. vol. 17, pp. S103-S115 (2007).

Furlan et al., "Behavior of microfludic amplifiers" Sensors and Actuators. vol. 51, pp. 239-246 (1996).

Furlan et al., "Comparison of Wall Attachment and Jet Deflection Microfluidic Amplifiers" Micro Electro Mechanical Systems, 1996, MEMS '96, Proceedings an Investigation of Micro Structures, Sensors, Actuators, Machines and Systems, IEEE the 9th Annual International Workshop. San Diego, CA pp. 372-377 (Feb. 11, 1996).

Grumann et al., "Batch-Mode Mixing on Certrifugal Microfluidic Platforms", Lab Chip. 2005. pp. 560-565. vol. 5.

Haeberle et al., "Certrifugal Micromixer", Chem. Eng. Technology. pp. 613-616. vol. 28, No. 5 (2005).

Sudarsan et al., "Multivortex Micromixing", Artie McFerrin Department of Chemical Engineering. vol. 103, No. 19. pp. 7228-7233. (2006).

Nguyen et al., "Micromixers—A Review", Institute of Physics Publishing. Journal of Micromechanics and Microengineering. vol. 15. pp. R1-R-16. (2005).

GB Combined Search and Examination Report for Application No. GB0823660.6 dated May 18, 2009.

GB Response to Search Report for Application No. GB0823660.6 dated Dec. 13, 2010.

International Search Report and Written Opinion for International Application No. PCT/PT2009/000081 dated May 10, 2010.

Fontana, "Theoretical and Experimental Study of the surface plasmon resonance effect on a recordable compact disk", Applied Optics. vol. 43, No. 7B pp. 79-87 Jan. 1, 2004.

Chiu et al.,Calculation of Surface Plasmon Effect on Optical Discs, Jap. J. Appl. Phys. Part 1, vol. 43, No. 7B, pp. 4730-4735 (2004).

Application and File History for U.S. Appl. No. 13/125,777, filed Aug. 12, 2011, inventors Da Fonseca et al.

Application and File History for U.S. Appl. No. 13/143,070, filed Sep. 28, 2011, inventors Da Fonseca et al.

Application and File History for U.S. Appl. No. 13/518,639, filed Jun. 22, 2012, inventors Da Fonseca et al.

International Search Report for International Application No. PCT/EP2012/074874 dated Apr. 11, 2013.

International Report on Patentability for PCT/PT2009/000055 issued Apr. 26, 2011.

Japanese Notification for Refusal for Japanese Application No. 2012-545894 dispatch date Mar. 4, 2014.

* cited by examiner

LIQUID DISTRIBUTION AND METERING

RELATED APPLICATIONS

The present application is a National Phase entry of PCT Application No. PCT/PT2011/000009, filed Mar. 26, 2011, which claims priority from Great Britain Application No. 1005294.2, filed Mar. 29, 2010, the disclosures of which are hereby incorporated by reference in their entireties.

BACKGROUND

The present invention relates to devices for handling liquid, in particular but not exclusively to distributing and metering liquids, more particularly in a microfluidic device such as a "lab on a disc" device.

Distributing and metering defined volumes of liquid (aliquots) is an essential step in many analytic and diagnostic procedures and constitutes an important unit operation for "lab on a disc" or other microfluidic platforms. In particular for point of care applications, it is desirable for aliquoting to be fast so that the overall processing time of the sample can be kept low.

An example of an aliquoting structure for metering a liquid into a plurality of aliquots is disclosed in U.S. Pat. No. 7,275,858 to Anderson et al. Anderson et al. disclose a centrifugal microfluidic, "lab on a disc", device with an aliquoting structure. The aliquoting structure has an inlet port, and outlet port and a plurality of aliquoting volumes in between, defined either by a meandering conduit or by a series of microcavities extending from a common continuous microconduit between the inlet and outlet ports. At an extremity of each meander bend or microcavity, an outlet opening is provided with a valve which provides a surface tension barrier to liquid flow. The barrier can be overcome by a centrifugal force due to rotation of the device. The inlet and outlet ports to the microconduit are positioned such that the device is filled by capillary action drawing liquid from the inlet port to the outlet port, filling the meandering bends or microcavities in the process. Devices like those disclosed in Anderson et al have drawbacks, in particular in point of care applications, in that the capillary effect or surface tension driven filling of the aliquoting structure is comparatively slow to the subsequent centrifugally driven distribution of liquid, adding to the overall processing time. Further, since the aliquots are maintained in their respective chamber by a surface tension barrier which is overcome by centrifugal force, the range of rotation speeds achievable with the device while the aliquots are filled and to be maintained within the respective chambers is limited to the burst frequency of the barrier at which the centrifugal force overcomes the surface tension barrier. Thus, the range of operations which can be carried out between filling of the aliquoting structure and dispensing of the aliquots is limited.

SUMMARY

In a first aspect of the present disclosure there is provided a device for handling liquid, the device being rotatable about an axis of rotation to drive liquid flow within the device. The device comprises a plurality of chambers, each adjacent to at least one other of the plurality of chambers. Each chamber has an inlet, an outlet connected to a respective outlet conduit and an overflow which defines a fill level to which the respective chambers are fillable with liquid from the inlet before overflowing. The inlet of one chamber of each pair of adjacent chambers of the plurality of chambers is connected to the overflow of the other chamber of the pair of chambers to fill the one chamber of the pair with liquid overflowing from the other chamber of the pair. Further, each outlet conduit defines an upstream portion and a downstream portion extending radially outward from a crest disposed radially inward of the respective fill level. Each outlet conduit is configured to urge liquid flow from the respective outlet port to the downstream portion by capillary action.

Thus, an aliquoting structure is provided with a chain of aliquoting chambers in which the overflow of one chamber fills the next one in sequence and in which outflow of the aliquots from the chamber is controlled by a conduit with a capillary siphon action, which acts to block outflow from the chambers while the device is rotated to fill the chambers under the influence of the centrifugal force and will continue to block liquid flow from the outlet as long as the device is rotated such that the centrifugal force experienced by the liquid in the upstream portion of the outlet conduit exceeds the force urging the liquid to flow into the outlet conduit, past the crest of the siphon defined by the outlet conduit into the downstream portion due to capillary action. As a result, the chambers can be filled from a liquid reservoir under the influence of centrifugation at any suitable rotational frequency of the device, which is typically faster than filling by capillary action. While the disc is spun (potentially at high speed) the aliquots are maintained within their respective chambers, further allowing other liquid processing steps to take place, such as centrifuging a sample to separate it into fractions, mixing other liquids or flushing a detection chamber before the aliquots are dispensed.

In some embodiments, the crest of the outlet conduit for at least one of the chambers is disposed radially outward of the fill level of an adjacent chamber with the outlet conduit arranged circumferentially between at least one of the chambers and an adjacent chamber, thereby providing a compact arrangement in which the length of the outlet conduit, and hence its resistance to flow, can be reduced relative to alternative arrangements. Similarly, in some embodiments, at least one of the chambers and an adjacent chamber have overlapping radial extend, thus providing radially compact arrangements (circumferentially spaced structures) which allow more processing functions to be fitted on a device of given radial dimension.

In some embodiments, the overflow of the last one of the plurality of chambers, that is the last one in the sequence of the chain of chambers, is linked to a detection chamber such that liquid overflowing from the last one of the plurality of chambers can be detected by a corresponding detector. Thus, detection of liquid in the detection chamber after the chambers have been filled indicates that all chambers have been filled correctly and, conversely, if no liquid is detected when the chambers should have been filled, this can be used as an indication of a fault having occurred. In this way, the device, or at least an analytical process requiring adequate aliquoting, can be immediately stopped and eventually discarded.

In some embodiments, a further chamber is connected between the overflow of the last one of the plurality of chambers and the detection chamber, so that it fills with liquid overflowing from the last one of the plurality of chambers. An outlet of the further chamber is connected to the detection chamber via an outlet conduit, in effect a siphon, which has a crest disposed radially inward of the outlet to define a fill level. The outlet conduit is arranged such that the further chamber fills to the fill level before emptying, while the device is rotated, through the outlet. Thus, by providing the further chamber with a siphon action conduit at its outlet, the crest of which is passed as liquid fills the further chamber, it can be assured that at least a minimum amount of liquid (corresponding to the fill level of the further chamber defined by the crest of its siphon) is dispensed to the detection chamber. In this way, it can be ensured that the liquid reaching the detection chamber is sufficient for, for example, flushing the detection chamber or filling it to allow a baseline reading to be taken from the detection chamber.

Further, in some embodiments, the detection chamber is linked to the outlet of at least one of the plurality of chambers to receive liquid from said outlet after aliquoting has been successfully accomplished and liquid has overflowed from the last one of the plurality of chambers. For example, this allows the same liquid to be used for an initial flushing of the detection chamber, as well as, subsequently, one or more of a baseline stabilisation under defined flow conditions, using the same liquid for diluting a sample in an intermediate structure to then reach the detection chamber together with the sample, and washing out detection areas from excess reactants which may interfere with detection to facilitate direct comparison of a final measurement with a previous baseline measurement.

In some embodiments, the outlet conduits are configured so that the chambers can be controllably emptied in a sequence by controlling the rate of rotation, such that at least one chamber can be caused to empty only after at least one other chamber has emptied. In some embodiments, the conduits are configured such that advance of the liquid, due to capillary action, across the fill level in the downstream portion can be controllably delayed by controlling the rotation of the device. This allows the respective aliquots from the plurality of chambers to be dispensed in a predefined sequence. Dispensing the aliquots in a sequence relies on, in effect, controlling priming of the outlet conduits by controlling rotation of the device. For example, by controlling the rotation of the device a first aliquot for mixing with a sample can be dispensed and then, after the sample has been processed, a further aliquot is dispensed to flush a detection chamber to which the sample has been provided. This may be useful to flush away excess sample or reactants and allow optical detection of sample molecules which are bound to probe molecules in the detection chamber.

The outlet conduits may be suitably configured to adjust the balance between the capillary action, which tends to fill the upstream portion of the outlet conduit, and the centrifugal force, which tends to urge liquid back into the chamber from the upstream portion. In some embodiments, this is achieved by adjusting the centre of mass and column height of a notional liquid column between the fill level and the crest of an outlet conduit of a given chamber and/or the cross-sectional area of the upstream portion of the outlet conduit. In some embodiments, the balance between the capillary and centrifugal force is controlled by adjusting the cross-section of the outlet conduits, the wetting properties of at least a portion of the outlet conduits, the conduit geometry, the conduit dimensions or a combination of these.

Thus, in some embodiments, the outlet conduits are configured such that a liquid head in the upstream portion of the outlet conduit of the at least one chamber is maintained within the upstream portion and a liquid head in the upstream portion of the at least one other advances into the respective downstream portion due to capillary action as the device rotates at a rotational frequency within a predetermined range of frequencies. The range of rotational frequencies is such that the centrifugal force overcomes the force due to the capillary effect for the at least one chamber while for the at least one other chamber the capillary force dominates.

It will be understood that there may be any number of chambers bigger than one, for example two chambers corresponding to a single pair of chambers or, in general, n chambers corresponding to n−1 pairs of chambers. Other chambers, configured differently, may also be present, connected in the chain or otherwise.

In a second aspect of the present disclosure, there is provided a device for handling liquid, the device being rotatable about an axis to drive liquid flow within the device. The device comprises a metering structure for metering one or more predetermined volumes of liquid and a detection chamber linked to the metering structure such that liquid in excess of the one or more volumes overflows into the detection chamber so as to be detectable by a corresponding detector.

Advantageously, the excess liquid overflowing into the detection chamber not only allows this liquid to be used, for example, for an initial flush of the detection chamber, but also provides and indication that all volumes of the metering structure have been filled.

In some embodiments, the metering structure is configured to dispense one or more of the volumes of liquid, in response to controlled rotation of the device, to interact with at least part of a sample loaded onto the device, or other reagents in either liquid or solid form. The metering structure may further be arranged in these embodiments such that liquid subsequently can flow with at least part of the sample to the detection chamber, after the excess liquid has flowed to the detection structure. In some embodiments, the metering structure is configured to meter two or more volumes of liquid and in response to controlled rotation of the device, to dispense one or more of the volumes to the detection chamber to rinse the detection chamber after one or more other ones of the volumes have flowed to the detection chamber with the sample. In some embodiments, the metering structure is linked to a further chamber as described above, ensuring that there is a minimum of excess liquid which reaches the detection chambers. It will be understood that there may be more than one detection chamber, for example a series of detection chambers linked by conduits and, for example, supplied via one or more intermediate supply chamber. In some embodiments, the metering structure comprises a device in accordance with the first aspect of the invention set out above.

In a third aspect of the present disclosure there is provided a drive system for a device in accordance with the first or second aspect of the invention. The system comprises a drive mechanism for engaging the device to rotate the device, a detector for detecting the presence of liquid in the detection chamber and a processor configured to generate a signal indicative of a fault if no liquid is detected in the detection chamber after the device has been rotated to fill the metering structure.

In a fourth aspect of the present disclosure, there is provided a device for handling liquid, the device being rotatable about an axis of rotation to drive liquid flow within the device. The device comprises a plurality of chambers having an inlet, and an outlet connected to a respective outlet conduit. Each outlet conduit defines an upstream portion and a downstream portion extending radially outward from a crest to define a siphon. Each outlet conduit is configured to urge liquid to flow from the respective outlet to the downstream portion by capillary action. The upstream portions of the outlet conduits of the plurality of chambers are configured such that priming of at least one of these outlet conduits can be delayed relative to priming at least one other outlet conduit by controlling the rotation of the device.

For example, in some embodiments, the device is arranged such that a liquid head in the upstream portion of an outlet conduit of at least one of the plurality of chambers is maintained within the upstream portion and a liquid head in the upstream portion of each other one of the plurality of chambers advances into the respective downstream portion due to the capillary action as the device rotates at a rotational frequency within a predetermined range of rotational frequencies.

Advantageously, in this aspect of the present disclosure, the emptying of the plurality of chambers can be sequenced by controlling the rotation of the device, so that a desired sequence can be achieved corresponding to a given sample treatment and analysis protocol. Detailed aspects of the configuration of the outlet conduits have been described above in relation to embodiments of the first aspect of the invention.

In a fifth aspect of the present disclosure, there is provided a device for handling liquid, the device being rotatable about an axis of rotation to drive liquid flow within the device and comprising one or more detection chambers for bringing the liquid into contact with a respective detection surface for the detection of specific components, e.g. specific molecules, present in the liquid. The device further comprises a vented waste chamber in fluidic communication with the one or more detection chambers through a waste conduit and a vented supply chamber in fluidic communication with the one or more detection chambers through a supply conduit for supplying liquid to the waste chamber through the one or more detection chambers. A sealed fluid path between the supply chamber and the waste chamber comprises the supply conduit, the one or more detection chambers and the waste conduit. The waste conduit extends radially inward of at least a portion of the supply conduit.

Advantageously, since the fluid path between the supply and waste chambers is only vented through these chambers, when this fluid path is filled with liquid it in effect, acts like a meandering conduit between communicating vessels, the radial extent of the waste conduit ensuring that the detection chambers do not empty when the supply chamber empties. This avoids the need to re-fill the detection chamber after emptying of the supply structure and is particularly advantageous if sensitive surface coatings, such as a coating of immobilised probe molecules (e.g. antibodies, or fragments thereof) are present on the detection surface, which could be affected if suddenly dried once wetted.

In some embodiments, the supply chamber and the supply conduit connect through a connecting portion which extends radially inward of the waste conduit and has a cross-sectional area which expands radially inwards, thereby reducing the risk of air ingress into the supply conduit on repeated cycles of filling and emptying of the supply chamber. The level of liquid in the connecting portion is substantially determined by the radial position of the port through which the waste conduit connects to the waste chamber. The one or more detection chambers may be configured in accordance with the following, sixth aspect of the present disclosure.

In a sixth aspect of the present disclosure, there is provided a device for handling liquid, the device being rotatable about an axis of rotation to drive liquid flow within the device and comprising a detection chamber for bringing the liquid into contact with a respective detection surface for the detection of components present in the liquid. The detection chamber has an inlet port for receiving liquid from an inlet conduit and an outlet port located radially inward of the inlet port for dispensing liquid received from the inlet port to an outlet conduit.

Advantageously, the location of the outlet port radially inward of the inlet port allows the detection chamber to be filled with a well-defined liquid front as the liquid level rises against the centrifugal force while the device is rotated. In some embodiments, the inlet port is adjacent or in a radially outermost aspect of the detection chamber and the outlet port is adjacent or in a radially innermost aspect of the detection chamber to maximise the distance over which the liquid level rises against the centrifugal force.

Embodiments of the first to sixth aspects of the present disclosure include microfluidic devices which, in some embodiments, may be substantially disc shaped. In some embodiments the axis of rotation is defined by a feature of the device for engaging a drive mechanism for rotating the device.

In a seventh aspect of the present disclosure, there is provided a method of manufacturing a device for controllably dispensing liquids from a plurality of chambers by controlling rotation of the device about an axis, the method comprising creating a design for the device including designing an outlet conduit for each of the chambers to have an upstream portion and a downstream portion extending radially outward from a crest so that liquid is maintained within the respective chamber as long as the device is rotated at a rotational frequency above a respective threshold frequency subsequent to rotating the device to fill the chambers, and to dispense liquid from a respective chamber after decelerating the device below the respective threshold frequency, wherein at least one of the threshold frequencies exceeds the remaining threshold frequencies, and manufacturing a device in accordance with the design.

In an eight aspect of the present disclosure, there is provided a method, and a corresponding system, for handling a sample in a rotational fluid handling device in a first, a second and a third phase of rotation. The phases are separated by decelerations between the first and second and second and third phases to respective threshold frequencies. In the first phase a sample is separated into fractions, a selected fraction is metered, a liquid (i.e. a dilutant for the selected fraction) is metered and a detection chamber is filled with liquid in the first phase. In the second phase, the metered selected fraction is mixed with a first metered volume of liquid to dilute the metered selected fraction and provide it to the detection chamber to allow interaction of the diluted fraction with the detection chamber. In the third phase, the detection chamber is flushed with liquid.

In a ninth aspect of the present disclosure, there is provided a method of detecting a fault in the operation of a rotational fluid handling device, including aliquoting a liquid into one or more volumes in an aliquoting structure for dispensing the volumes to downstream fluid handling structures including a detection chamber. The method further includes checking the presence of liquid in excess of the one or more volumes which has overflowed from the aliquoting structure to the detection chamber and detecting a fault condition if no excess liquid is detected in the detection chamber.

Devices which control liquid flow within the device by rotation of the device are generally termed centrifugal microfluidic devices and in cases where the device thickness is substantially smaller than the device diameter they are often referred to as "lab on a disc" devices; these concepts are used interchangeably below. For the avoidance of doubt the terms "metering" or "aliquoting" refer to measuring one or more predefined volumes of liquid from an input liquid, for example from a liquid reservoir, and holding these volumes of liquid such that they are controllably releasable for later use. A metering or aliquoting structure is a structure configured to embody this function, for example comprising a plurality of interconnected chambers which define pre-defined volumes for the aliquots. The term "chamber" is used in a broad sense to designate a liquid retaining structure. It is to be understood that the term metering structure or aliquoting structure also encompasses a structure which meters only a single predefined volume.

The term "siphon" (or "siphon action") is used to refer to any liquid conduit connected to a chamber and which extends radially inward to a bend defining a crest separating the siphon into an upstream and downstream portion and then radially outward again, so that a driving force, such as a centrifugal force, causes continued liquid flow from the chamber through the siphon once the liquid has crossed the crest into the downstream portion to a position radially beyond the liquid level in the chamber. The term "crest" is used in its broadest sense referring to a locus on a surface (or conduit) from which the surface (or conduit) extends radially outward on either side of the locus. Thus, for the avoidance of doubt, a siphon connected to an outlet in a radially outermost aspect of the chamber and for which the downstream portion extends radially outward of the outlet of the chamber will empty the chamber completely once the crest has been crossed as long as a centrifugal force is maintained and the liquid column is not broken.

The term "capillary siphon" is used to refer to a siphon structure which is dimensioned so that the capillary effect urges liquid to flow from the chamber into the siphon and, specifically, across the crest and into the downstream portion radially beyond the level of liquid in the chamber. Once liquid is in contact with the upstream portion of a capillary siphon and the device is not rotated (or rotated at a frequency such that any capillary force dominates) the capillary siphon primes. The term "primed" is used to designate a capillary siphon in which liquid has moved past the crest and the level of liquid in the chamber due to the capillary action so that subsequent rotation (or acceleration) of the device will cause a siphon action as described above. The term "priming", etc, is to be understood accordingly.

Where the term "level" is used in relation to a chamber or other liquid retaining structure, it will be understood that this does not necessarily refer to a straight level as would be observed in a chamber filled with liquid under gravity (ignoring surface tension effects), but that the term includes curved levels, which may be curved due to a centrifugal force acting on the liquid or due to a surface tension effect, as long as this corresponds to a well-defined amount of liquid in the liquid retaining structure. The "level" is not limited to the liquid retaining chamber, but rather defines a geometric locus, e.g. relative to a centre of rotation.

Where the term "vented" or "vent" is used in relation to a chamber or other liquid retaining structure, it will be understood that this refers to the chamber or other structure being in fluidic communication with atmospheric air, outside a device of which the chamber or other structure is a part, or with a closed air circuit of the device such that an air pressure in the chamber or other structure is kept substantially constant when volume changes of a liquid in the chamber or structure occur. A closed air circuit allows air to move around the device from regions where air is displaced to regions where a negative pressure would otherwise result, thus equilibrating pressure in the device without the need for an open connection to atmospheric air.

BRIEF DESCRIPTION OF THE DRAWINGS

Embodiments of the invention are now described by way of example only and with reference to the accompanying drawings in which.

DETAILED DESCRIPTION

Figure 1:
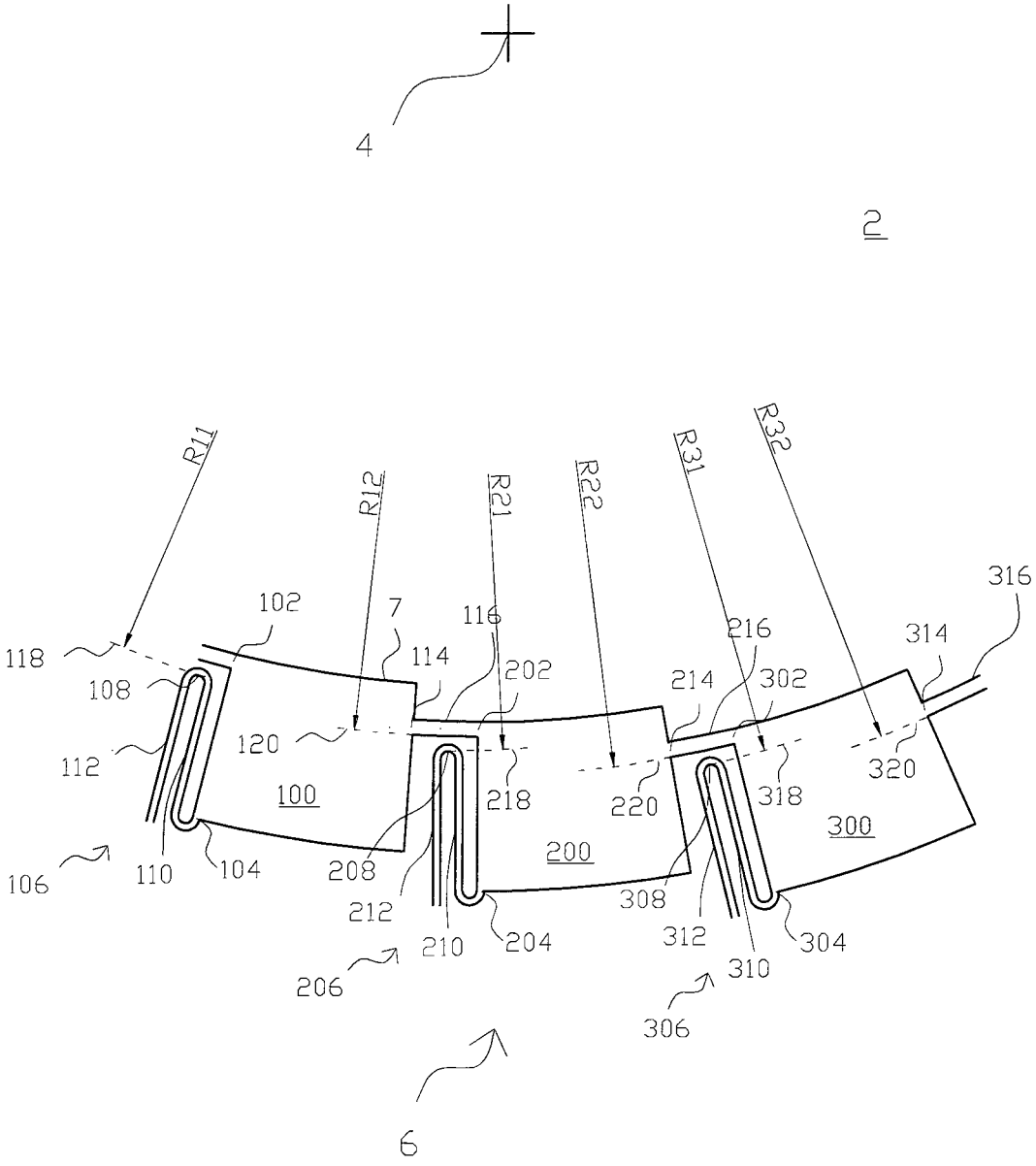
FIG. 1 illustrates an embodiment of a metering structure having a plurality of interconnected chambers.

With reference to FIG. 1, a centrifugal or "lab on a disc" microfluidic device 2 arranged for rotation about an axis 4 comprises an aliquoting structure 6 which has three chambers, 100, 200, 300. Each chamber has an inlet port 102, 202, 302 and an outlet 104, 204, 304 connected to an outlet conduit 106, 206, 306. The outlet conduit defines a crest 108, 208, 308, separating the outlet conduit into an upstream portion 110, 210, 310 connected to the outlet port 104, 204, 304 and a downstream portion 112, 212, 312 connected to downstream fluidic structures of the device 2. The crest 108, 208, 308 is defined by a radially outward surface of the conduit at a radially inward facing bend such that the conduit is separated by the crest 108, 208, 308 into the upstream portion 110, 210, 310 and the downstream portion 112, 212, 312 extending radially outwards on either side of the crest 108, 208, 308. The crests 208 and 308 are located circumferentially between respective adjacent chambers 100, 200 and 200, 300 and radially between the respective fill levels of respective adjacent chambers 100, 200 and 200, 300.

The outlet conduit 106, 206, 306 extends radially outward from the chamber 100, 200, 300 from the outlet port 104, 204, 304 (located in a radially outermost aspect of the chamber), so that the upstream portion 110, 210, 310 defines a first radially outward facing bend where the conduit turns radially inward towards the crest 108, 208, 308. This arrangement facilitates complete emptying of the chambers 100, 200, 300, provided that the downstream conduit 112, 212, 312 extends radially outwards beyond the outlet port 104, 204, 304 and the first bend of the upstream portion 110, 210, 310.

Each chamber 100, 200, 300 further has a respective overflow port 114, 214, 314 connected to an overflow conduit 116, 216, 316. The inlet port 202, of the chamber 200 is connected to the overflow port 114 of the chamber 100 by the overflow conduit 116 and the inlet port 302 of the chamber 300 is connected to the overflow port 214 of the chamber 200 by the overflow conduit 216. The overflow conduit 316 of the chamber 300 is connected to atmospheric air for venting the metering structure 6. The overflow conduit 316, in some embodiments, is connected to a waste chamber for holding any excess liquid after chambers 100, 200 and 300 have been filled or, in some embodiments to other fluid handling structures where the excess liquid is further used. This is described in more detail below. In some embodiments the overflow conduit 316 is connected to further downstream chambers configured substantially like the chambers 100, 200, 300 to provide further aliquoting chambers for the aliquoting structure 2. In these embodiments, the connection to atmospheric air may be provided by the last one of these further chambers. Indeed, in all embodiments, a connection to atmospheric air or a vent port may be provided at any location in the metering structure as long as all chambers 100, 200, 300 and any further chambers are in fluidic communication with the vent port or atmospheric air.

The upstream portion 110, 210, 310 of the outlet conduits 106, 206 and 306 are dimensioned so that liquid is urged from the outlet port 104, 204, 304 into the outlet conduit 106, 206, 306, due to a capillary (surface tension) effect, so that in the absence of other forces such as a centrifugal force due to a rotation of the device 2, a liquid inside the outlet conduit 106, 206, 306 will advance radially inside of the level of liquid inside the chamber 100, 200, 300 towards the crest 108, 208, 308 and past this point into the downstream portion 112, 212, 312. The dimensions of the upstream portion 110, 210, 310 suitable to achieve a sufficient capillary effect depend on the wetting behaviour of the surfaces contacted by the liquid inside the device. Capillary filling typically requires contact angles at the gas-liquid-solid interface (or contact line) smaller than 90 degrees and at least one cross-sectional dimension below 1 mm, and preferably below 0.5 mm for typical applications. A largest transverse dimension of 0.5 mm of the outlet conduit 106, 206, 306 has been found to be sufficiently small to achieve a sufficient capillary effect for aqueous solutions in polymeric substrates exhibiting contact angles smaller than 60 degrees.

The crest 108, 208, 308 defines a threshold level 118, 218, 318. If the chamber 100, 200, 300 is filled above the threshold level, a centrifugal force due to a rotation of the device 2 urges liquid in the upstream portion 110, 210, 310 downstream into the downstream portion 112, 212, 312. If the chamber is filled below the threshold level, the effect of the centrifugal force depends on the presence and position of liquid in the downstream portion 112, 212, 312. If no liquid is present in the downstream portion 112, 212, 312 or present only radially inward of the liquid level in the chamber 100, 200, 300, the centrifugal force acts to level the liquid in the chamber and upstream portion (in the manner of communicating vessels), otherwise the chamber is emptied by a siphon action due to the centrifugal force since the outlet conduit has then been primed.

The overflow port 114, 214, 314 defines fill level 120, 220, 320 to which the chamber 100, 200, 300 can fill with liquid from the inlet port 102, 202, 302 and beyond which liquid overflows through the overflow port 114, 214, 314. In the embodiment, illustrated in FIG. 1, the radially outer aspect of the outlet conduit 116, 216, 316 does not extend radially inward of the overflow port 114, 214, 314 so that the fill level 120, 220, 320 is defined by the overflow port 114, 214, 314. It will be understood that in embodiments where the radially outer aspect of the overflow conduit 116, 216, 316 extends radially inward of the overflow port 114, 214, 314, it will be the radially innermost point of that aspect of the overflow conduit 116, 216, 316 which defines the fill level 120, 220, 320. The fill level 120, 220, 320 is disposed radially outward of the threshold level 118, 218, 318. The overflow port 114, 214, 314 and the overflow conduit 116, 216, 316 are configured such that the rate of liquid overflowing from the chamber 100, 200, 300 is always larger than the rate of liquid flowing into the chamber from the inlet 102, 202, 302. In this way, the outlet conduit 110, 210, 310 will not prime as long as the device is continued to be rotated at a sufficiently high frequency after filling the chambers 100, 200, 300.

In operation, liquid from a liquid reservoir (not shown in FIG. 1) connected to the inlet port 102, is caused to flow into the chamber 100 by rotating the device 2 about the axis 4, so as to fill the chamber 100 and the upstream portion 110 of the outlet conduit 106, until the fill level 120 is reached. At this stage the level of liquid in the chamber 100 does not rise further and liquid begins to overflow via the conduit 116 to the chamber 200 and the upstream portion 210 of the outlet conduit 206, which fill up to the fill level 220. At this point liquid overflows into the chamber 300 and the upstream portion 310 of the outlet conduit 306, which now fill up to the fill level 320. At this point liquid overflows into the overflow conduit 316 to further aliquoting chambers and respective outlet conduits or other downstream liquid handling structures. During this filling process (and for any desired period of time after it) the disc is rotated to create a centrifugal force acting on any liquid head defined by the radial difference between the liquid level in the upstream portion of the outlet conduit and the level of liquid inside the respective chamber. The disc is rotated at a frequency sufficiently high so that the resulting centrifugal force dominates over the capillary effect in the upstream portion 110, 210, 310 of the outlet conduit 106, 206, 306. As long as a sufficiently high rate of rotation is maintained, liquid will be retained in the chamber 100, 200, 300 because the radial distance R12, R22, R32 of the fill level 120, 220, 320 from the axis 4 is larger than the radial distance R11, R21, R31 of the threshold level 118, 218, 318 from the axis 4. The fill level 120, 220, 320 thus defines the volume of liquid retained in each chamber of the structure (aliquot). The chambers are designed to retain a given (metered) liquid volume which may be identical or different from chamber to chamber. Once the device 2 is stopped or slowed sufficiently, the capillary effect in the upstream portion 110, 210, 310 dominates over any centrifugal force acting on a liquid head in the upstream portion of the outlet conduit. At this point, the outlet conduit 106, 206, 306 primes so that a subsequent increase in the rotation frequency of the device 2 will cause the chamber 100, 200, 300 to empty under the influence of a corresponding centrifugal force.

In some embodiments, the conduit 316 (or the last overflow conduit of the aliquoting structure, as the case may be) is connected to downstream fluid handling structures so that excess overflowing liquid flows to a detection chamber of the device 2 as the device is rotated after filling the chambers 100, 200, 300. The detection chamber is arranged such that the presence of the excess liquid can be detected by a corresponding detector, for example, external to the device 2, allowing a fault condition to be indicated when no or insufficient liquid has reached the detection chamber. This indicates that the chambers 100, 200, 300 have not filled completely, which can be used to indicate a fault condition for the device.

Figure 2:
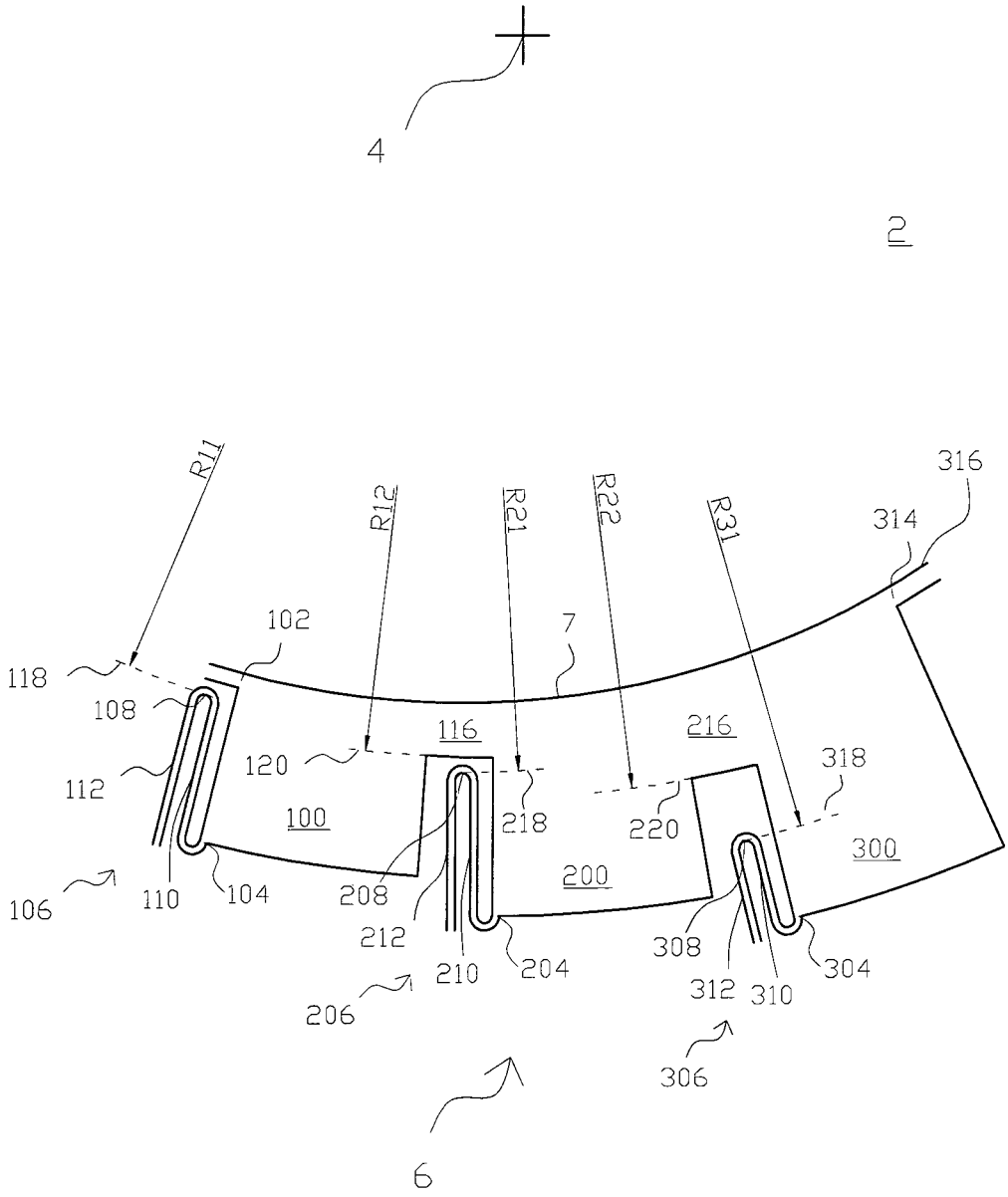
FIG. 2 illustrates a metering structure having a plurality of interconnected chambers which are arranged to controllably empty at different times.

With reference to FIG. 2, embodiments are now described in which one of the chambers, (specifically chamber 200) is arranged to empty after another one of the chambers (specifically chamber 100) as the device 2 is rotated again after slowing down subsequent to filling the chambers.

Further, embodiments are described with reference to FIG. 2 in which one of the chambers (specifically chamber 300) is arranged not as a aliquoting chamber but as a further chamber configured to dispense excess liquid during the initial rotation of the device 2 when the aliquoting structure 6 has been filled, and to ensure that excess liquid is only dispensed from it during the initial rotation of the device 2 if a minimum volume of liquid has overflowed. It will be understood that in some embodiments only one of these features (sequentially emptying of chambers and minimum volume overflow chamber), is present and that each or both of these features may be combined with a larger number of aliquoting chambers and may be disposed in any order in a chained arrangement of chambers, that is a chamber dispensing liquid later need not be arranged in the sequence of filling the chambers, after a chamber dispensing liquid earlier. However, the minimum volume overflow chambers should be arranged in a chain of chambers so as to be filled last.

In the specific arrangement depicted in FIG. 2, the chamber 100 is configured substantially as the chamber 100 of FIG. 1.

The chamber 200 is also configured substantially as the corresponding one in FIG. 1, but the radial distance between the threshold level 218 and the overflow level 220 is greater than the radial distance between corresponding levels 118 and 120 of the chamber 100. As discussed in detail below this allows the emptying of the chamber 200 to be delayed until after the emptying of the chamber 100 by controlling the rotation of the device 2. The chamber 300 differs from the chamber 300 in FIG. 1 in that the outlet port 314 and outlet conduit 316 have been raised radially inward of the threshold level 318, so that this chamber now does not act as a aliquoting chamber but rather as an overflow chamber which ensures liquid only overflows to downstream fluid handling structures if a minimum volume in the chamber 300 defined by the threshold level 318 is reached, as described below.

Referring now to chambers 100 and 200, in order to enable sequential emptying, subsequent to filling of these chambers, the balance between the capillary effect and centrifugal force experienced by a liquid head in the upstream portion 210 at or near the crest 208 is biased in favour of the capillary force as compared to the upstream portion 110, at or near the crest 108. In other words, the outlet conduit 206 is configured such that, at a given rate of rotation, the centrifugal force experienced by a liquid head in the upstream portion 210 at or near the crest 208 (relative to the liquid level in the chamber 200 when filled to the fill level 220) is higher than the centrifugal force experienced by the liquid head in the upstream portion 110, because the radial distance (and corresponding liquid head as defined above) between the levels 220 and 218 is greater than the radial distance between the levels 120 and 118. Thus, when decreasing the rotational frequency of the device, after filling the aliquoting structure, to a frequency where the capillary force dominates in the upstream portion 110 but not in the upstream portion 210, the liquid will advance past the crest 108, into the downstream portion 112 and past the fill level 120 but not past the crest 208 and fill level 220. As a result, the outlet conduit 106 but not the outlet conduit 206 is primed. When the rotational frequency is subsequently increased, the chamber 100 but not the chamber 200 will empty. Thus, by controlling the rotational frequency, it can be ensured that the chamber 100 empties first, followed by emptying of the chamber 200 only when the frequency of rotation is then lowered sufficiently so that the outlet conduit 206 primes, as well. Once the outlet conduit 206 has primed, liquid can be dispensed from the chamber 200 by subsequent rotation of the device 2.

A number of factors determine the balance between the capillary effect and the centrifugal force in the upstream portions 110, 210. The liquid pressure on the column of liquid between the fill level 120, 220 (to which the upstream portion 110, 210 fills due to liquid pressure from the chamber 100, 200 when it is filled) and the threshold level 118, 218 is proportional to the product of the centre of mass of the column and the height of the column (or difference between levels 118, 218 and 120 and 220), that is proportional to $$(R21-R22)(R21+R22)/2$$

i.e. proportional to $$R21^2-R22^2.$$

Analogously for the chamber 100, the corresponding pressure is proportional to $$R11^2-R12^2.$$

Provided the surfaces contacting the liquid display identical wetting properties and dimensions, the capillary force urging the liquid in to the upstream portion is substantially the same and the balance between the capillary force and the centrifugal force is determined by the radial location of the threshold and fill levels. The centrifugal force experienced by a liquid column between levels 218 and 220 in upstream portion 210 can be increased relative to that experienced a liquid column in the upstream portion 110 between levels 118 and 120 by ensuring that $$R21^2-R22^2>R11^2-R12^2.$$

For example, this can be done by ensuring that the liquid column in between the two levels is higher in the upstream portion 210 than in the upstream portion 110, where the respective liquid columns are located substantially at the same or similar radial distance. Additionally or alternatively, this can be achieved by providing the liquid column of the outlet conduit which is to prime later (outlet conduit 206) radially outward of the liquid column in the outlet conduit which is intended to prime earlier (outlet conduit 106). The arrangement shown in FIG. 2 makes use of both of these effects.

The arrangement described above has an increased radial extent of the aliquoting structure compared to a simultaneously emptying structure, since the distance between threshold levels and overflow levels is increased from one chamber to the next. If there are several aliquoting chambers in the aliquoting structure to be sequentially emptied as described above this effect is magnified. Hence, in some embodiments, the transverse cross-sectional area of the outlet conduit 206 is larger relative to that of the outlet conduit 106. This decreases the strength of the capillary effect experienced by the liquid in the upstream portion 210 when compared to that in the upstream portion 110. In this case, the need to increase the radial distance between threshold levels to increase the centrifugally induced pressure in the liquid head can be reduced and even avoided. The balance between capillary and centrifugal forces is shifted by manipulating the capillary effect in addition to or in place of manipulating the centrifugal force. In some embodiments, the capillary effect is, additionally or alternatively, manipulated by adjusting the surface properties of the upstream portion and/or the chamber in the region of the outlet. Thus, an increase in the transverse cross-sectional area of conduit 206 relative to the conduit 106 can additionally or alternatively be used to shift the balance in favour of the centrifugal force in conduit 206 relative to conduit 106 to retain the liquid in the chamber 200 while allowing the outlet conduit 106 to prime (or shifting the balance for conduit 106 relative to conduit 206 in favour of the capillary force by decreasing the transverse cross-sectional area of conduit 106 relative to conduit 206, or both).

The above discussion, with reference to FIG. 2, of some embodiments for sequential emptying of aliquoting chambers is predicated on upstream portions 110, 210 having substantially constant transverse cross-sections. However, the principles discussed above are equally applicable to more general configurations and/or surface properties of the outlet conduit 206, in which case the effect of the shape of the upstream portion 110 on the capillary effect will be more intricate.

The capillary effect is influenced by the cross sectional geometry and dimensions of the liquid conduits, as well as the surface properties of the liquid confining surfaces, which control the liquid-solid wetting behavior. The wetting behavior is commonly characterized by the liquid-solid contact angle which determines the shape of the liquid front (meniscus) inside the conduits. The pertinent contact angle in capillary driven flow is the dynamic contact angle, i.e. the actual angle while the liquid is flowing as opposed to the static contact angle (as measured by well established sessile drop techniques) which in the present case is also affected by the centrifugal force. At high rotation frequencies a flattening of the meniscus curvature due to centrifugally induced pressure can be observed, whereas at lower frequencies the contact angle tends to the dynamic contact angle observed in the absence of centrifugal forces. Other effects determining capillary force are related to the cross sectional shape, such as for example the presence of sharp corners or the use of different materials in the walls of the conduits as these affect the shape of the meniscus and hence the capillary behavior. The latter effects are common in microfluidics and result from the manufacturing processes employed, which in many cases provide for rectangular or trapezoidal grooves in one substrate with a second substrate is used to seal the channel. All these effects and their complex interplay can be taken into account in the device design to obtain the desired capillary behavior.

The cross sectional alteration described above employs different, although substantially constant cross sectional areas, for each of the outlet conduits in order to shift the balance between centrifugal and capillary pressures. However, in some embodiments the outlet conduits 100, 206, 306 are designed with a gradient in cross section as a function of length, in particular in the upstream portions 110, 210, 310 of the outlet conduits in some embodiments. This enables changing the capillary effect as the liquid advances in upstream portion, enabling more fine-grained adjustment of the balance between capillary and centrifugal forces. In some embodiments the capillary effect is additionally or alternatively, manipulated by controlling the surface properties of the liquid confining surfaces to change the liquid-solid wetting behavior. This is typically achieved using surface coatings or methods to modify the surface chemistry to achieve a different liquid/solid contact angle in order to favor the capillary force in one of the outlet conduits relative to others.

In particular, in embodiments where fluid handling structures are formed in a substrate layer by layer, for example by lithography, it is advantageous to adjust the width (rather than the depth into the substrate) of the outlet conduits in order to adjust the conduit geometry or dimensions. This reduces the number of different depths in the design, reducing the number of layers (and hence lithographic masks in the example above) required for manufacture. This applies whether the width along the conduit is constant or varies, for example with a constant gradient.

Common to all these embodiments is the underlying concept of manipulating the balance between capillary and centrifugal forces in the upstream portion 110, 210 so that at least one of a plurality of chambers will prime at a higher rotational frequency than at least one other of the plurality of chambers, so that the at least one chamber can be caused to empty, subsequent to filling, by decelerating the device 2 to a first rotational frequency to cause priming of the at least one chamber, re-accelerating the device 2 to cause emptying of the at least one chamber while liquid continues to be held in the at least one other chamber, decelerating the device again to a second rotational frequency less than the first rotational frequency so that an outlet conduit of the at least one other chamber primes and the at least other chamber then empties as the device is again re-accelerated.

Alternatively, the effect that a longer outlet conduit or an outlet conduit of larger transverse cross-section of the at least one other chamber takes longer to prime than a shorter or narrower cross section outlet conduit of the at least one chamber can be used. The outlet conduit of the at least one chamber can be primed by briefly stopping or decelerating the device 2 for a period of time too short for the outlet conduit of the at least one other chamber to prime, so that only the at least one chamber empties on subsequent rotation, the at least one other chamber requiring a further stop or deceleration of sufficient length and magnitude to allow the outlet conduit to prime in order to be emptied by renewed rotation. In these embodiments, the device can be decelerated to the same rotational frequency to prime each chamber in turn.

While embodiments have been described in which two chambers are emptied sequentially, sequential emptying in additional sequence steps of one or more chambers at a time is achieved in some embodiments by designing the outlet conduits to define a corresponding number of threshold rotation frequencies for priming the respective outlets and/or different time frames for priming respective outlets at the same rotational frequency.

With reference to the chamber 300, as briefly outlined above, the crest 308 is radially outward of the port 314, so that the outlet conduit 306 will prime as soon as the liquid in the chamber 300 reaches the threshold level 318 at the radial distance R31 from the axis 4, at which point chamber 300 will start to empty through the downstream portions 312 while the device is being rotated without the need for an intervening decrease of the rotational frequency. This allows overflow liquid to be provided to downstream liquid handling structures, for example a detection chamber as briefly described above, while at the same time ensuring that overflow liquid is only provided to the downstream structures once a minimal amount of liquid corresponding to the level 318 has overflowed from the chamber 200 (or in some embodiments a single aliquoting chamber or a chain of three or more aliquoting chambers) because the centrifugal force will tend to urge liquid back into the chamber 300 until the threshold level 318 has been reached.

In some embodiments, the crest 308 is radially inward of the port 314, so that the outlet conduit 306 only primes once the device 2 has been slowed down to a sufficiently low rotational frequency. In these embodiments the fill level is defined by the port 314. To ensure that the chamber 300 empties first amongst all chambers, the outlet conduit 306 is arranged so that this threshold frequency is higher than for the other chambers. In this way, fault detection using the detection zone is effective to ensure that all chambers have been filled.

Comparing FIGS. 1 and 2, it will be apparent that the radially innermost wall 7 of the aliquoting structure 6 is disposed differently in that it follows the layout of the chambers 100, 200, 300 to define a similar airspace above the fill levels 120, 220, 320 in FIG. 1 and is at a constant radial distance from the axis 4 in FIG. 2. It will be noted that the shape of this wall is to some extent arbitrary and, in some embodiments, the wall 7 can be omitted entirely so that the chambers 100, 200 and 300 communicate with a common open airspace radially inward of the chambers.

Figure 3A:
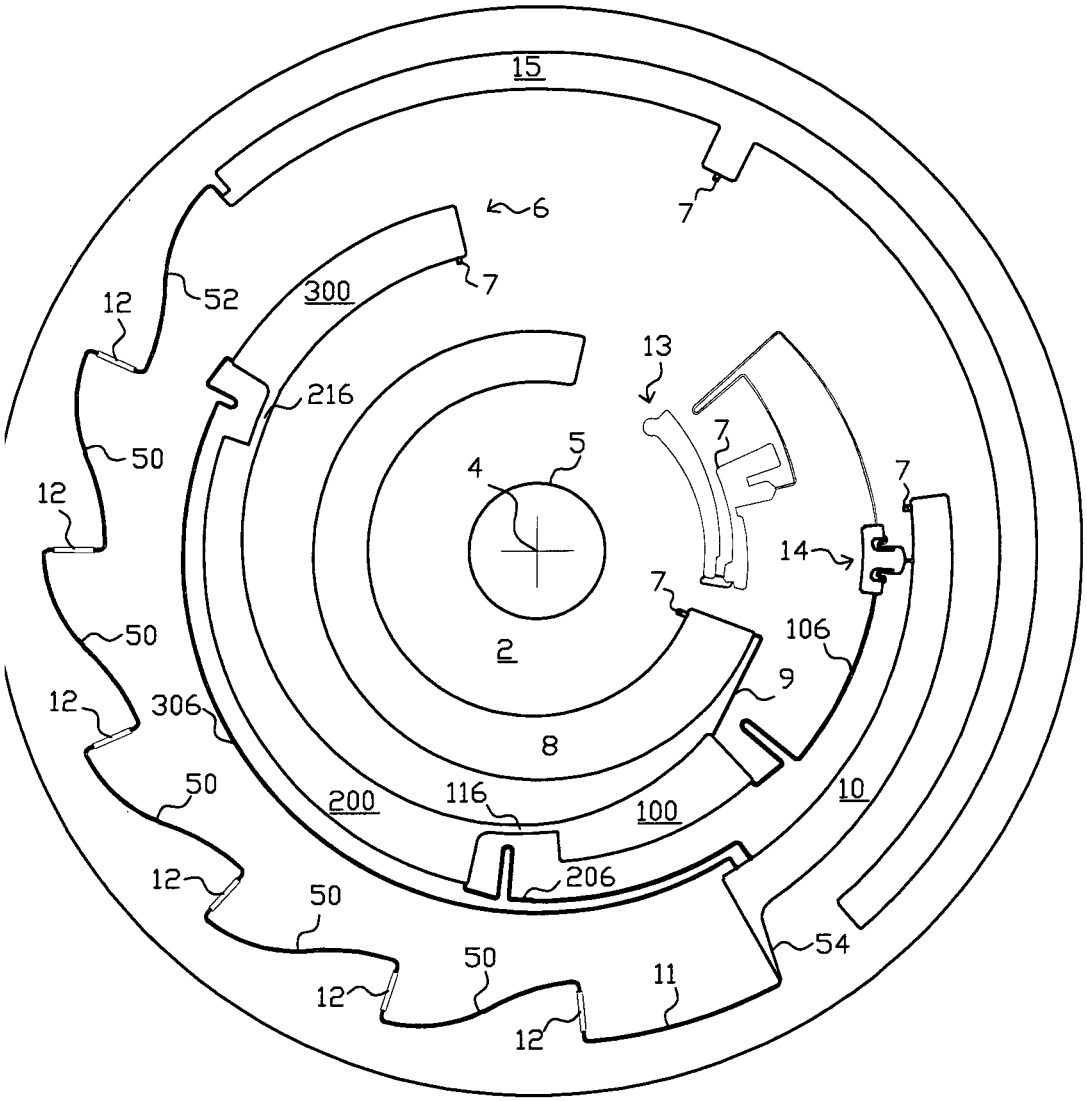
FIGS. 3A to 3C illustrate a disc-shaped fluid handling device incorporating the metering structure of FIG. 2, a sample processing structure, a mixing structure and a plurality of detection chambers.
Figure 3B:
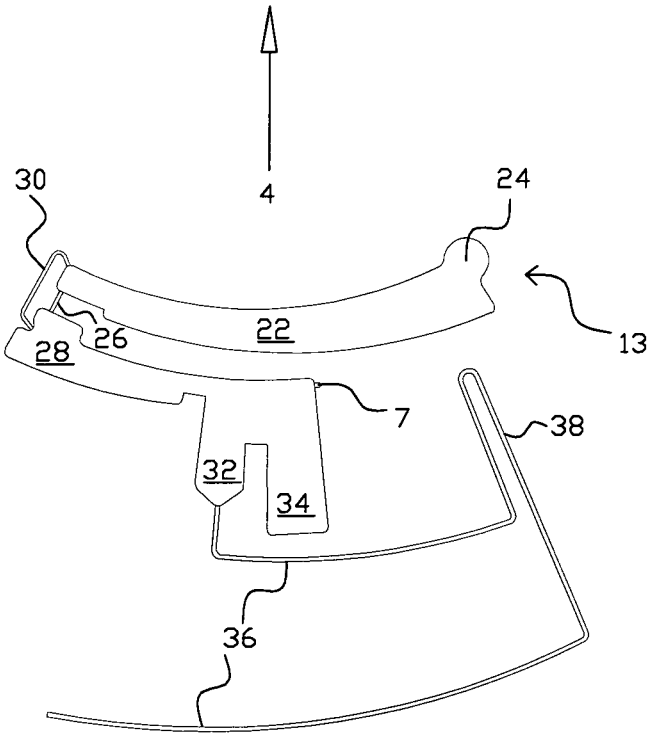
Figure 3C:
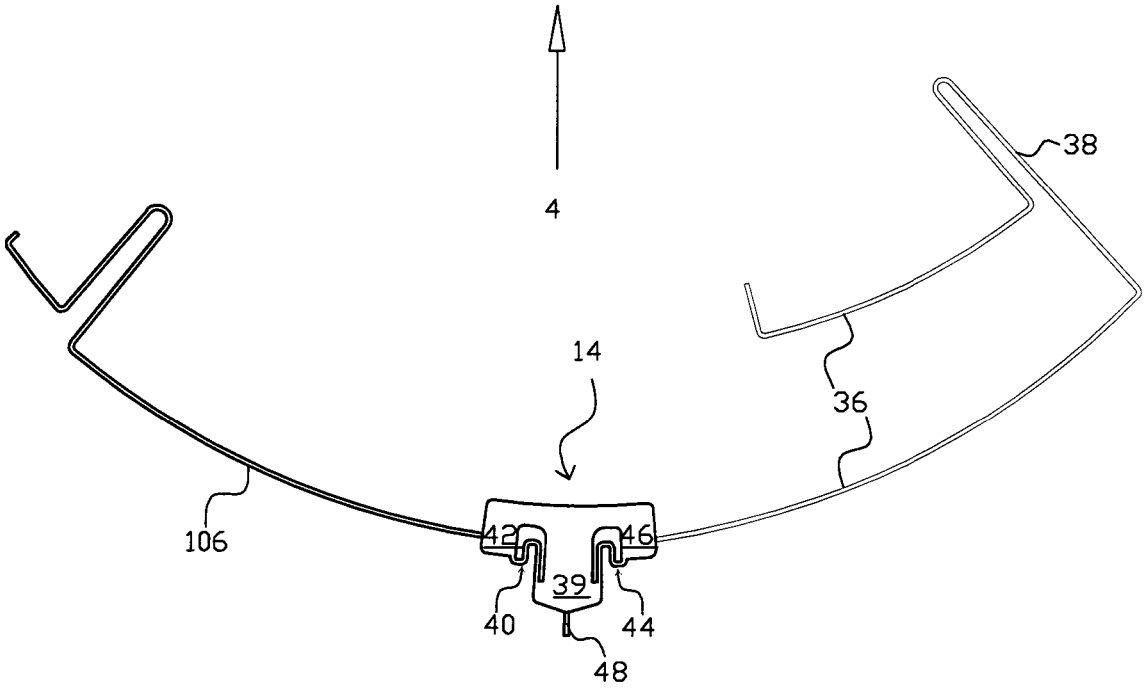

With reference to FIGS. 3A-3C, an embodiment illustrating integration of an aliquoting structure 6 as described above with other fluid handling structures on the device 2 is now described. The device 2 is provided on a disc-shaped substrate (of, for example, 12 cm diameter) and comprises a radially inward liquid reservoir 8 to provide a liquid head radially inward of the aliquoting structure 6 (that is at a higher centrifugal potential when the disc is rotated). Connections 7 to atmospheric air or a closed air-circuit of the device are provided at a number of locations. The closed air circuit, in some embodiments, is formed in a cover (not shown) for the substrate shown in FIG. 3A or in an intermediate layer bonded between the cover and the substrate.

The liquid reservoir 8 is connected to the chamber 100 via a conduit 9 and the interconnection between the chambers 100, 200 and 300 are as described above, via overflow conduits 116, 216. The outlet 306 (for dispensing a minimum volume of excess liquid) is connected to a detection chamber 12 via a supply chamber 10. In some embodiments, the detection chamber 12 is one of a sequence of two or more linked detection chambers. The detection chamber 12, in turn is connected to a waste chamber 15 either directly or via one or more further detection chambers 12. In some embodiments, the detection chamber comprises probe molecules immobilized on a detection surface and is arranged to enable detection of binding of target molecules in a sample by changes in surface plasmon resonance at the detection surface. The outlet conduit 106 of the chamber 100 is connected to a mixing structure 14, which in turn is connected to the supply chamber 10. The mixing structure 14 is connected to receive a sample from an upstream sample processing structure 13. In the embodiments of FIGS. 3A-C, this is a structure, for example, for handling a blood sample and separating blood plasma from blood cells within the sample and then providing the plasma to the mixing structure 14 to be mixed with the aliquot from the chamber 100. The aliquot from the chamber 300 is arranged to issue into the supply chamber 10 directly via conduit 206. An outlet of the supply chamber 10 is connected to the detection chamber 12 by a supply conduit 11.

The sample processing structure 13, in the specific embodiment illustrated in FIGS. 3A-3C, is arranged to separate a blood sample into plasma and cellular fractions and to meter a pre-defined volume of plasma while the device is being rotated. The sample processing structure is now described in detail with reference to FIG. 3B.

With reference to FIG. 3B, the sample processing structure comprises a separation chamber 22 which has a sample inlet 24 and an outlet 26 leading into a receiving chamber 38. The receiving chamber 28 is vented back to the separating chamber 22 by a vent 30. The opening of the vent 30 into the receiving chamber 28 is adjacent the opening of the outlet 26 into the receiving chamber 28. The height of the receiving chamber 28 (perpendicular to the plane of the Figure) is arranged so that liquid entering through the outlet 26 forms a liquid membrane across the receiving chamber 28 to separate the receiving chamber into two compartments.

In use, the separating chamber 22 is isolated from outside atmospheric air by closing the blood inlet 24 (for example using an adhesive flap) and the receiving chamber 28 is in fluidic communication with outside air through an air system connection 7 opposite the opening of the vent 30 from the opening of the outlet 26. As the liquid level in the separation chamber 22 drops when liquid flows through the outlet 26 to the receiving chamber 28 in response to a centrifugal driving force as the device is rotated, a negative pressure is created in the separating chamber 22. The negative pressure deflects the membrane of liquid in the receiving chamber 28 into the vent 30 until a liquid plug is formed in the vent 30. At this stage, the vent 30 is blocked and flow through the outlet 26 seizes so that the blood sample remains in the separating chamber 22 and separates into plasma and cellular material under the influence of the centrifugal force.

A portion of the separating chamber 22 is arranged to be radially beyond the connection of the separating chamber 22 to the outlet 26 so that the separated cellular material remains inside the separating chamber 22 as flow through the outlet 26 is re-established. This is achieved by a change in the speed of rotation (acceleration or breaking) of the device to dislodge the liquid plug from the vent 30. The receiving chamber is in fluidic communication with a metering structure 32 and shaped so that blood plasma flows from the receiving chamber 28 to the metering structure 32 while at the same time retaining remaining cellular components. The metering structure 32 is in fluidic communication with an overflow structure 34 such that a defined volume is retained in the metering structure 32 with any excess plasma flowing into the overflow structure 34.

The metering structure 32 is connected by a conduit 36 to the mixing structure 14. The conduit 36 defines a capillary siphon 38 arranged to stop flow in the conduit 36 past the capillary siphon 38 as the device is rotated at a sufficiently high frequency and, as the device is stopped or slowed down sufficiently, to prime the capillary siphon 38 due to capillary action.

The capillary siphon 38 is arranged to prime at about the same rotational frequency as the conduit 106 of the chamber 100 and the conduits 106 and 36 are arranged such that the respective liquids (aliquot and plasma, respectively) have flow rates corresponding to the mixing ratio of the liquids, taking account of the respective viscosities.

With reference to FIG. 3C, the mixing structure comprises a common chamber 39 into which a first siphon structure 40, fed from a corresponding first inlet chamber 42, and a second siphon structure 44, fed from a corresponding second inlet chamber 46, issue. The conduit 106 is connected to the first inlet chamber 42 and the conduit 36 is connected to the second inlet chamber 46. The siphon structures 40, 44 are arranged to empty the corresponding inlet chambers 42, 46 at a rate which is higher than the rate at which the corresponding inlet chamber 42, 46 fill. Thus, once the liquid in the corresponding inlet chamber has reached a level at which the siphon fills with liquid beyond its crest, the inlet empties chamber before it starts to fill again. The siphon structures thereby issue discrete volumes of liquids into the common chamber 48 from where they proceed though a common conduit 48 to the supply chamber 10. The common chamber 38 is connected to atmospheric air via the common conduit 48, which has been found to encourage the discrete volumes issuing from one siphon structure at a time, further encouraging the intermingling of the respective liquid and hence mixing.

The mixing ratio of a dilutant (e.g. PBS) from the chamber 100 and sample from the metering structure 32 is determined by the respective flow rates into the mixing chamber. The conduits 106 and 36 are configured so that the respective flow rates are achieved for a desired mixing ratio. In some embodiments the inlet chambers 42, 46 have respective volumes (defined by the level at which the siphons 40, 44 fill with liquid beyond their crest) in the same proportion so that the discrete volumes tend to issue alternatingly from each siphon.

In one specific schedule of operation, the device is accelerated at 50 rev/sec$^2$ to 50 Hz to form the plug, followed after 3 seconds by separation and aliquoting at 40 Hz (deceleration at 50 rev/sec$^2$) for 60 seconds and then dislodging the plug using one or more cycles of acceleration and deceleration to frequencies between 30 and 120 Hz to allow metering of plasma. Then, after a deceleration to prime the conduits 106 and 36, the disc is accelerated again to 40 Hz for mixing and delivery of diluted plasma to the supply chamber 10.

Additional details and alternative embodiments for the sample processing structure 13 and the mixing structure 14 can be found in the applicant's co-pending applications PCT/PT2009/000055 and PCT/PT2009/000081, herewith incorporated by reference herein. In particular, in some embodiments, other discretisation mechanisms such as surface tension barriers at an outlet of the inlet chamber 42, 46 are employed in place of siphon outlets. Equally, some embodiments employ a sequentially staged mixing structure, as described in detail in PCT/PT2009/000081 and illustrated in FIG. 4.

Figure 4:
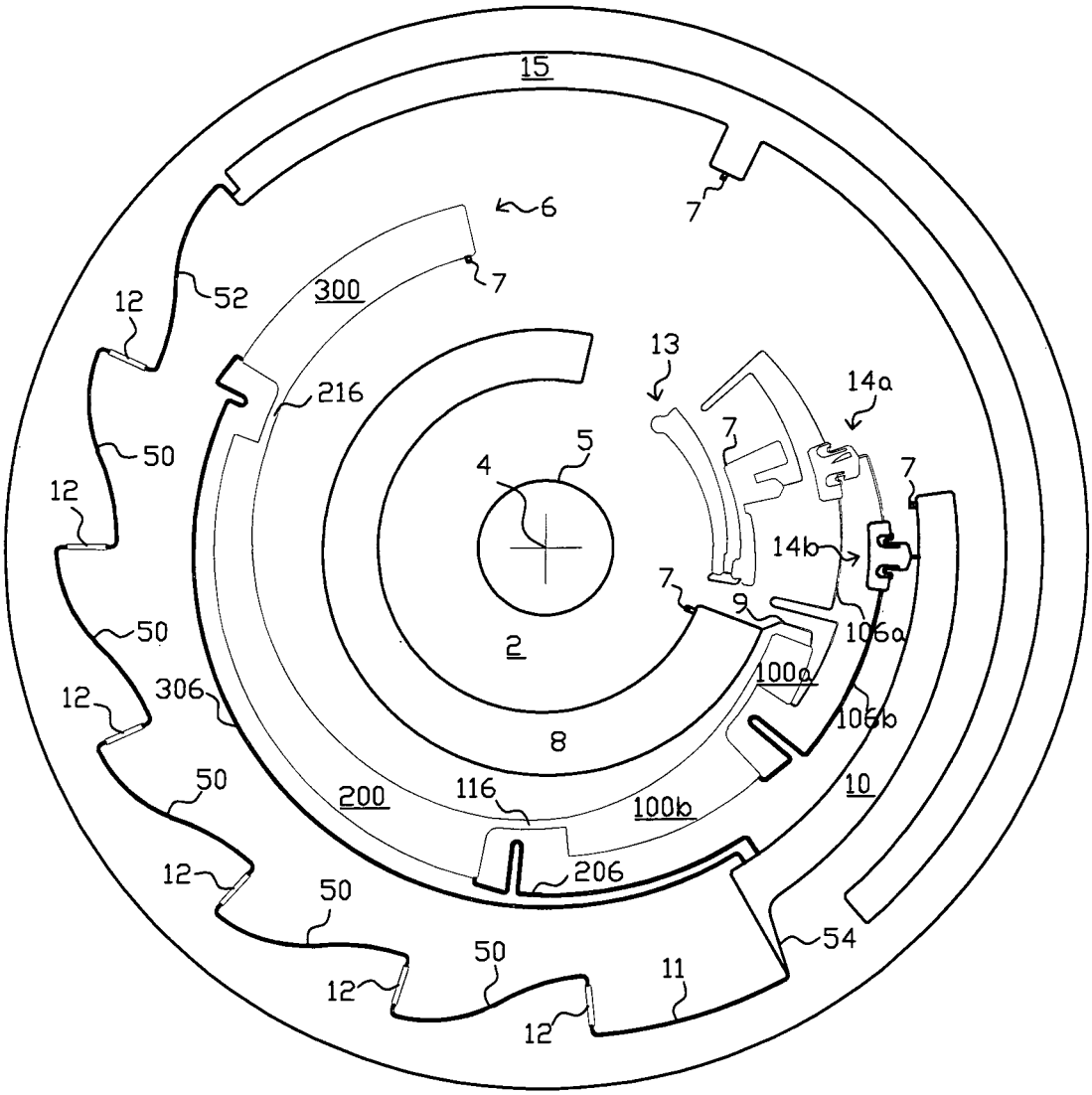
FIG. 4 illustrates a disc-shaped fluid handling device incorporating an alternative mixing structure.

Briefly, with reference to FIG. 4, a sequentially staged mixing structure comprises a first mixing structure 14*a* similar to the one described above and a second mixing structure 14*b* also similar to the one described above. The first mixing structure 14*a* receives dilutant form a first dilutant chamber 100*a* via a conduit 106*a* and a sample, e.g. blood plasma, from the sample processing structure 13. The first mixing structure comprises a feature adjacent the sample discretisation structure for removing bubbles caused by issuing discrete volumes of the sample, in particular when handling samples with a tendency to stabilise liquid membranes, such as blood plasma. This feature is described in detail in PCT/PT2009/000081. The second discretisation structure 14*b* receives the once diluted sample from the first discretisation structure and dilutant for further dilution from a second dilutant chamber 100*b* via a conduit 106*b*. The conduit 106*b* is designed to prime at the same rotational frequency as the conduit 106*a*, based on the principles described above.

Additionally, the conduit 106*b* includes a surface tension barrier, e.g. a sudden expansion, arranged to halt advance of liquid in the conduit 106*b* while the device 2 is spun at a frequency at which the conduits 106*a* and 106*b* prime and located so that the time for liquid to advance from the barrier to the second mixing structure 14*b* is the same as the time for liquid to advance from the inlets of the first mixing structure 14*a* to the second mixing structure 14*b*. By spinning the device 2 at the above-mentioned frequency for a sufficient amount of time before re-accelerating, so that the liquids have time to reach the surface tension barrier and first mixing structure 14*a*, subsequent substantially synchronous arrival of the liquids at the mixing structure 14*b* is facilitated. In alternative embodiments, the second mixing structure is placed so that the lengths of the conduit 106*b* and the conduit linking the mixing structures 14*a* and 14*b* are such that synchronous arrival of the liquids is facilitated.

Figure 5:
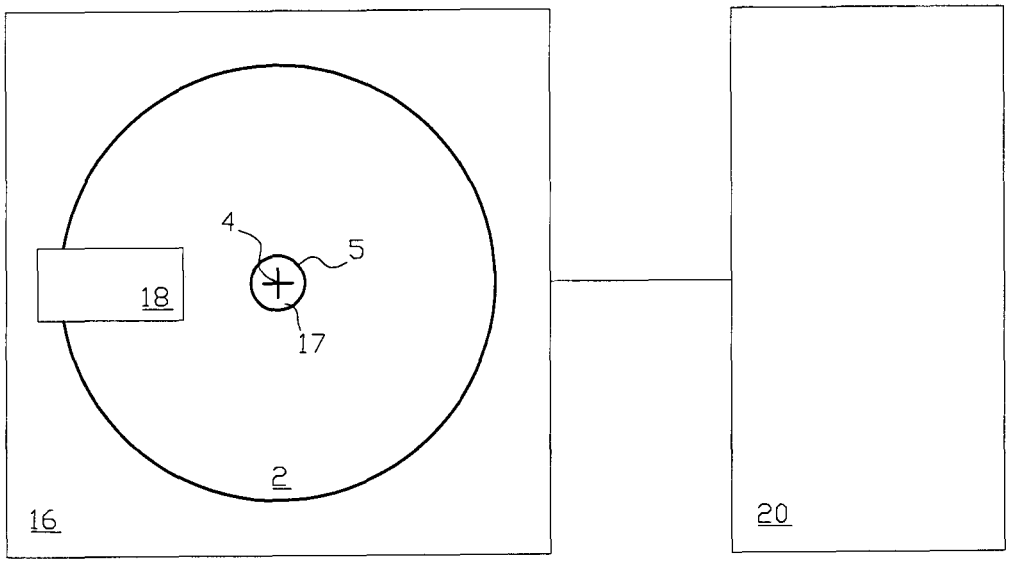
FIG. 5 illustrates a reader system for devices as described below with reference to FIGS. 3A to 3C and 4.

With reference to FIG. 5, a reader 16 for the device 2 comprises a drive spindle for engaging a feature 5 of the device 2 so that the device 2 can be rotated about the axis 4 by driving the spindle 17 with a suitable motor in the fashion of a Compact Disc drive. The reader 16 further comprises a detector 18, in some embodiments arranged to detect changes in surface plasmon resonance and is connected to a processor 20 which controls the rotation of the device 2 and receives input from the detector 18. The reader is adapted to "read" the detection chambers 12 of the device 2 while the device 2 is rotated. A trigger mechanism for triggering detection from each detection chamber 12 as the disc rotates (for embodiments employing changes in surface plasmon resonance as the detection mechanism) is disclosed in the applicant's co-pending application PCT/PT2010/000055, herewith incorporated herein by reference. The spacing of the detection chambers 12 is at least in part determined by the response time of the reader and the rotational rate of device if all detection structures 12 are to be read in a single revolution. Otherwise, these factors do not necessarily limit the spacing between the detection zones 12 since the detection zones 12 can be read in alternation skipping one or more detection zone 12 between reads on each revolution and using a number of revolutions to read all detection zones. For example every second detection zone 12 can be read in one revolution, requiring two revolutions to read all detection zones 12.

In operation, a sample is loaded onto the device 2, which is provided with suitable dilution liquid in the reservoir 8 and the device is then placed in the reader. During a first spin of the device 2, liquid from the reservoir 8 fills the chambers 100 and 200 with any overflow excess liquid filling the chamber 300 until the threshold level 318 is reached, at which point excess liquid from the chamber 300 overflows into the detection chamber 12, where it can be detected by the detector 18 either during the initial spin or as the device 2 is slowed down or stopped. When the processor 20 does not receive an expected signal from the detector 18 after a predetermined time during the first spin (or after slowing down or stopping), a fault signal is generated by the processor 20, stopping the device 2 and alerting a user that a fault occurred due to insufficient liquid being provided from the reservoir 8 so that the chambers 100 and/or 200 did not fill completely or the minimum excess liquid volume was not reached in the chamber 300. If sufficient liquid is detected in the detection chamber or structures, the procedure proceeds, utilising the now filled detection chamber or chambers 12 to obtain a baseline reading.

In an alternative embodiment, rather than using an overflow chamber like chamber 300 for the fault detection/baseline functionality, a further chamber like chamber 200 can be used instead, the device being arranged so that the further chamber can be emptied before the chamber or chambers preceding it by controlling the rotation of the device, e.g. by arranging its outlet conduit to prime at the highest rotational frequency of all outlet conduits, as described above. The further chamber is immediately downstream of a chamber supplying liquid to a sample handling structure such as the mixing structure 14 in some embodiments, while there are one or more intervening chambers in the aliquoting structure in other embodiments.

During the first spin, the sample processing structure 13 processes the sample, for example separating a blood sample while the device is spun to provide blood plasma to the mixing structure 14, where it is mixed with liquid from the outlet conduit 106 during a second spin once the device 2 has been slowed down sufficiently for the conduit 106 to prime and has been re-accelerated. The specific arrangement of the sample processing structure described above allows separation and metering of blood plasma to occur during the first spin, with only a temporary acceleration or braking (to a rotational frequency higher than that at which the conduit 106 primes) needed to dislodge the plug from the vent and begin metering of plasma. When the device has been slowed down significantly, capillary forces cause the respective liquids in the conduits 106 and 36 to advance past the respective capillary siphon and to continue until they meet a sudden expansion at the respective entrance to the mixing structure 14, where the advance halts due to the surface energy barrier represented by this expansion. In the second spin, on re-acceleration, liquid, e.g. plasma, from the conduit 36 is mixed with the liquid, e.g. dilutant, from the outlet conduit 106 before it proceeds to the detection chambers 12 where the sample can react with probe molecules provided in the detection chamber 12 to provide assays for target molecules in the sample.

Once the sample has been caused to flow across the detection chamber or structures 12 in this way, the device is again decelerated to prime the conduit 206. During a third spin, upon re-acceleration of the device 2, liquid from the chamber 200 flows to the detection chamber or structures 12 to wash excess sample into the waste chamber 15, following which the detector 18 can be used to detect binding of target molecules in the sample to probe molecules in the detection chamber or structures 12, using the processor 20 to compare the baseline reading to a reading after the detection chamber has been washed and/or perform differential readings between detection zones. Thus, the chambers 100, 200 and 300 provide an integrated way to provide initial rinsing, recording of a baseline and sample separation in a first spin, diluting and applying the sample in a second spin and, subsequent washing and detection of bound sample in the detection chamber or chambers 12 in a third spin (or detection following the third spin). Thus, a compact spin protocol is provided.

In some of the embodiments described above, the priming sequence of the outlet conduits is controlled by the balance of centrifugal and capillary forces, controlling priming by deceleration below different respective threshold rates of rotation. In some embodiments described above, temporal delays (due to the length or geometric arrangement of the outlet conduits) are utilised to sequence priming, in which case the decelerations between spins can be to the same threshold frequency (including zero), while ensuring that the first and subsequent decelerations are sufficiently short to only cause the respective desired outlet conduits to prime.

Returning to FIGS. 3A and 4, the one or more detection chambers 12 are linked by conduits 50 in a sequence from a first detection chamber adjacent the supply chamber 10 to a last detection chamber adjacent the waste chamber 15. The first detection chamber is connected to the supply chamber 10 by a supply conduit 11 and the last detection chamber is connected to the waste chamber 10 by a waste conduit 52. The waste conduit 52 extends radially inwards of at least a portion of the supply conduit 11. Since the supply conduit 11, detection chambers 12, conduits 50 and waste conduit 52 form a sealed fluid path (vented only through the supply chamber 10 and the waste chamber 15), this arrangement ensures that the detection chambers 12, once filled, do not empty when the supply chamber 10 empties, for example when different liquids are applied in sequence.

The supply chamber 10 has a radially outer contour at substantially constant radial distance from the centre of rotation 4 over most of its circumferential extent, apart from a region where it connects to the supply conduit 11. There, the supply chamber 10 forms a funnel-like connection portion 54 extending radially outward to meet the supply conduit, with a transverse cross-sectional area which expands radially inward away from the supply conduit 11. In another perspective, the supply conduit 11 thus has a transverse cross-sectional area which expands radially inward in a connection portion 54 towards an outlet port of the supply chamber 10. The inwards expansion is of substantially continuous curvature, that is substantially smooth, although a linear expansion or other shape is equally envisaged. The expansion may be in any one or more dimensions of the connection portion 54 although in some embodiments, the expansion is in the width of the connection portion 54.

At least a part of the connection portion 54 is radially inward of an inlet port of the waste chamber 15 where the waste conduit 52 connects to the waste chamber 15, so that at least part of the connection portion 54 is emptied on emptying of the supply chamber 10. The configuration of the connection portion 54 reduces the risk of bubble formation in the connection portion 54 when the supply chamber is filled subsequent to having emptied previously. This reduces the risk of air ingress into the supply conduit 11 and consequently the detection chambers 12 in this situation.

If it is desirable for flow conditions in the detection chambers 12 to be consistent over time, e.g. to have substantially constant flow rates, it is desirable to keep variations of the liquid head (the radial extent of an unbroken liquid column in the connection portion 54 and supply chamber 10) applied to the detection chambers 12 low. To that end, the circumferential extent of the supply chamber 10 is significantly greater than the greatest circumferential extent of the connection portion 54 and the supply chamber 10 and connection portions 54 are arranged such that the radial extent of liquid inside the supply chamber 10 is smaller than that in the connecting portion 54. As a result, most volume is located in the supply chamber and changes in volume over time as liquid flows through the detection chambers 12 results in a relatively small change in the liquid head experienced by the detection chambers 12 as long as the circumferential extent of the supply chamber 10 is filled. This is because the large circumferential extent of the supply chamber relative to the circumferential extent of the connection portion 54 and supply conduit 11 means that the change in radial height in the supply chamber 10 is relatively small for a significant portion of liquid flow.

The detection chambers 12 may be formed in a number of ways. In some embodiments, the detection chambers are defined by, in effect, enlarged portions of the conduits 11, 50 and 52. In some embodiments, the detection chambers are again defined in the same substrate as these conduits but are of a shallower depth than these conduits. This is advantageous, since it increases the ratio of the area of a detection surface disposed within the detection structure 12 to the volume of the detection chamber 12. In some embodiments, the equivalent effect is achieved by forming the conduits 11, 50 and 52 as dead end conduits within the substrate and forming a chamber for the detection chamber 12 either in a cover for the substrate of the device 2 (see below) or as a cut-out in an intermediate layer bonded between the cover and the substrate. The chamber or cut out form a fluidic connection between the dead ends of the conduits 11, 50 and 52 when the cover (and intermediate layer, if applicable) are bonded (or otherwise secured) to the substrate. The chamber or cut out may have any appropriate base area, for example disk like, rectangular (elongate or square, rounded or not), diamond shaped, lozenge shaped, etc. Constructions including any number of layers are equally possible provided that intermediate layers between that or those defining conduits 11, 50 and 52 and the other or others defining detection areas 12 are in fluidic communication and define a continuous path from the supply to the waste chamber.

Depending on the embodiment, the resulting structure has an inlet port where the detection chamber connects to the supply conduit 11 or, as the case may be, one of the adjacent connecting conduits 50 adjacent or in a radially outermost aspect of the detection chamber 12 and an outlet port where the detection chamber connects to the conduit waste 52 or one of the adjacent connecting conduits 50 as the case may be, adjacent or in a radially innermost aspect of the detection chamber 12. The outlet of each detection chamber 12 is thus radially inward of the respective inlet of each detection chamber. This arrangement reduces the risk of bubble formation as the detection chambers fill radially inward against the centrifugal force, facilitating the formation of a well-defined liquid front progressively filling each detection chamber 12.

Each detection chamber comprises a detection surface for interaction with specific components, e.g. specific molecules, in the liquid, so that for example selected target molecules (e.g. proteins or nucleic acids) present in the liquid can be detected. For example the detection surface comprises a coating containing immobilised probe molecules (e.g. antibodies or fragments thereof or complementary nucleic acid sequences) arranged to come into contact with the liquid any bind any corresponding target molecules therein. The detection surface can be disposed on the substrate or cover but must be interrogatable from outside the device, for example by detecting an optical signal such as fluorescence of a tag attached to target molecules.

In some embodiments, the detection surface is arranged such that the binding of target to probe molecules can be detected label-free by detecting a local change in refractive index based on a corresponding change of surface plasmon resonance at the (metallised diffraction grating) detection surface, for example as described in the applicant's applications PCT/PT2007/000048 and PCT/PT2007/000047, herewith incorporated by reference herein. By functionalising the detection surfaces of the detection chambers with different respective probe molecules, the presence or absence of a corresponding number of different target molecules can be detected as the sample liquid flows through all detection chambers in sequence and hence the same sample can interact with the corresponding detection surfaces. A simple detection process typically involves three steps of an initial baseline reading with a reference liquid, the application of sample liquid and the washing out of non-bound sample from the detection chambers.

Microfluidic devices as described above are, in some embodiments, fabricated by standard lithographic procedures. One approach is the use of photo-resists of different thickness to obtain multiple depth structures. These films are provided by spin coating or lamination of dry-films on transparent polymeric disc shaped substrates. The substrates are provided with fluidic connections such as inlet and outlet ports by punching, milling or laser ablation. Specifically, the devices described above have, in some embodiments, reservoir (e.g. chamber) and conduit depths of, respectively, 100 and 50 micrometers. Other manufacturing techniques are used in some embodiments and include direct laser ablation, CNC milling, hot embossing, injection moulding or injection/compression moulding of PMMA (polymethyl methacrylate), PC (polycarbonate), PS (polystyrene), COP and COC (cyclocolefin polymers and co-polymers).

After forming the fluid handling structure on one substrate, typically a next step is required to confine the fluid handling structure using a second substrate or film. Bonding of polymeric materials can be achieved by a variety of means including the use of adhesion promoting materials (e.g. liquid glues, solid adhesives, radiation curing, laser bonding, catalyst assisted bonding, solvent assisted bonding or thermally activated adhesion promoters), or through direct application of temperature (thermo-lamination) provided there is intimate contact of the bonding surfaces. In particular, the microfluidic structures may be produced in one or both of two clear substrates, one clear and one darkly pigmented substrate or two darkly pigmented substrates depending on the analysis and detection applications performed subsequently to the microfluidic processing. In some embodiments, one of the halves may be at least partially metallised (and define a diffraction grating or prism) to facilitate certain optical detection processes, such as surface plasmon resonance detection.

As described above, in some embodiments fluid handling structures such as an air circuit or at least some of the walls of a chamber for one or more detection chambers to bring liquid in contact with respective detection surfaces are formed in the second (cover) substrate or film or in an intermediate substrate or film bonded between outer layers of the device.

The above description of details embodiments of the invention is made by way of illustration and not for the purpose of limitation. In particular, many alterations, modifications and juxtapositions of the features described above will occur to the person skilled in the art and form part of the invention.

For example, the invention is not limited to a microfluidic scale but applications an other, for example macroscopic, scales are equally envisaged. For the avoidance of doubt, the term "microfluidic" is referred to herein to mean devices having a fluidic element such as reservoir or a channel with at least one dimension below 1 mm. The device need not be disc shaped and, indeed, the axis of rotation need not be provided within the device itself, but the device can be arranged to be placed in the rotor for rotating it about an axis of rotation not within the device itself.

It will be understood that, while the above description has been made in terms of three specific chambers, the invention is not so limited, and applies to aliquoting structures having any number of aliquoting chambers to provide any number of aliquots. It will further be understood that, although the placement of the inlet of a siphon action conduit at a radially outermost outlet port of a chamber and the provision of a downstream portion extending beyond the outlet port radially are the usual implementation for such structures, the outlet port may be provided at a location which is not at the radially outermost of the aliquoting chamber. Similarly, the outlet port may be radially outward from the termination of the downstream portion of the conduit, in which case the chamber will only empty to the level dictated by the termination of the downstream portion. While, in the embodiments described above, the crests of the outlet conduits are disposed in between aliquoting chambers, in some embodiments one or more, possibly all of the crests are disposed to one side of the aliquoting structure, subject to the constraint that each crest and the corresponding threshold level is radially inward of the fill level of the respective aliquoting chamber.

Finally, while embodiments providing sequential dispensing of aliquots have been described in terms of sequentially filled aliquoting structures, other embodiments provide sequential dispensing of liquids from a plurality of chambers in general, not limited to aliquoting structures or sequentially filled aliquoting structures.

The invention claimed is:

1. A device for handling liquid, the device being rotatable about an axis of rotation to drive liquid flow within the device and comprising a plurality of chambers each adjacent to at least one other of the plurality of chambers and each chamber of the plurality of chambers having an inlet, an outlet connected to a respective outlet conduit, and an overflow conduit which defines a fill level to which the respective chamber is fillable with liquid from the inlet before overflowing, the inlet of a second chamber of each pair of adjacent chambers being connected to the overflow conduit of a first chamber of each pair of adjacent chambers to fill the second chamber of each pair with liquid overflowing from the first chamber of each pair, and each outlet conduit defining an upstream portion, a downstream portion and a crest disposed radially inward of the respective fill level, the upstream portion and the downstream portion extending radially outward from the crest, and being configured to urge liquid to flow from the respective outlet port to the downstream portion by capillary action.

2. A device as claimed in claim 1 in which the crest of the outlet conduit of the second chamber of at least one pair of adjacent chambers is disposed radially between the fill levels of the first and second chamber of the at least one pair and circumferentially between the first and second chambers of the at least one pair.

3. A device as claimed in claim 2 in which the crest of the outlet conduit of the second chamber of each pair of adjacent chambers is disposed radially between the fill levels of the first and second chambers of each pair of adjacent chambers and circumferentially between the first and second chambers of each pair of adjacent chambers.

4. A device as claimed in claim 1 in which at least one of the chambers and a chamber adjacent to it have overlapping radial extent.

5. A device as claimed in claim 4 in which the chambers of each pair of adjacent chambers have at least partially overlapping radial extent.

6. A device as claimed in claim 1 in which the inlet of a first one of the plurality of chambers is connected to a liquid reservoir for holding a liquid head radially inward of the plurality of chambers.

7. A device as claimed in claim 6, the liquid reservoir and plurality of chambers having at least partially overlapping circumferential extent.

8. A device as claimed in claim 1 in which one of the plurality of chambers is configured as a last chamber, and the overflow conduit of the last chamber is linked to a detection chamber such that liquid overflowing from the last chamber can flow to the detection chamber so as to be detectable with a corresponding detector.

9. A device as claimed in claim 1, comprising a last chamber having an inlet connected to the overflow conduit of an adjacent one of the plurality of chambers, the last chamber having a further outlet connected to a further outlet conduit defining a further upstream portion and a further downstream portion extending radially outward from a further crest disposed radially inward of the further outlet to define a further fill level to which the last chamber is fillable before liquid flows from the further chamber through the further downstream portion.

10. A device as claimed in claim 9 in which the further downstream portion is linked to a detection chamber such that liquid flowing from the last chamber can flow through the further downstream portion to a detection chamber so as to be detectable with a corresponding detector.

11. A device as claimed in claim 8 in which the detection chamber is linked to the outlet of at least one of the plurality of chambers to receive liquid from said outlet after receiving liquid which has overflowed from the last chamber.

12. A device as claimed in claim 1 in which there are N chambers in the plurality of chambers and N−1 pairs of adjacent chambers, with N>1.

13. A device as claimed in claim 1, in which the device is a microfluidic device.

14. A device as claimed in claim 1, in which the device is substantially disc-shaped.

15. A device as claimed in claim 1, in which the axis of rotation is defined by a feature of the device for engaging a drive mechanism for rotating the device.

* * * * *